US005931684A

United States Patent [19]

Obendorf et al.

[11] Patent Number: 5,931,684

[45] Date of Patent: Aug. 3, 1999

[54] COMPACT ELECTRICAL CONNECTIONS FOR ULTRASONIC TRANSDUCERS

[75] Inventors: William D. Obendorf, Chelmsford; Brevard S. Garrison, Reading; Matthew Mooney, Westford, all of Mass.

[73] Assignee: Hewlett-Packard Company, Palo Alto, Calif.

[21] Appl. No.: 08/934,246

[22] Filed: Sep. 19, 1997

[51] Int. Cl.[6] ..... H01R 9/09

[52] U.S. Cl. ..... 439/67; 310/366

[58] Field of Search ..... 310/322, 334, 310/365, 366, 348

[56] References Cited

U.S. PATENT DOCUMENTS

| | | | |
|---|---|---|---|
| 3,496,617 | 2/1970 | Cook et al. | 29/25.35 |
| 3,587,561 | 6/1971 | Ziedonis | 600/453 |
| 3,718,898 | 2/1973 | Cook et al. | 367/155 |
| 3,952,387 | 4/1976 | Iinuma et al. | 29/25.35 |
| 4,117,074 | 9/1978 | Tiersten et al. | 310/320 |
| 4,211,948 | 7/1980 | Smith et al. | 310/322 |
| 4,211,949 | 7/1980 | Brisken et al. | 310/322 |
| 4,217,684 | 8/1980 | Brisken et al. | 29/25.35 |
| 4,281,550 | 8/1981 | Erikson | 73/626 |
| 4,385,255 | 5/1983 | Yamaguchi et al. | 310/335 |
| 4,404,489 | 9/1983 | Larson, III et al. | 310/334 |
| 4,462,092 | 7/1984 | Kawabuchi et al. | 367/105 |
| 4,470,308 | 9/1984 | Hayakawa et al. | 73/642 |
| 4,479,069 | 10/1984 | Miller | 310/334 |
| 4,576,045 | 3/1986 | Miller-Jones | 73/626 |
| 4,686,408 | 8/1987 | Ishiyama | 310/334 |
| 4,734,963 | 4/1988 | Ishiyama | 29/35.35 |
| 5,482,047 | 1/1996 | Nordgren et al. | 439/74 |

FOREIGN PATENT DOCUMENTS 1530783 11/1978 United Kingdom .

*Primary Examiner*—Neil Abrams
*Assistant Examiner*—T C Patel

[57] ABSTRACT

An element connection assembly for connecting elements of an ultrasonic transducer stack mounted on a frame to wires of a cable and having a plurality of transmitting and receiving elements and including a element lead assembly and a connection assembly. The element lead assembly has a plurality of leads connected to the element connections, is located along a first side of the frame and includes a first and second lead zone areas spaced apart transverse to the longitudinal axis of the frame and separated by a folding line. Groups of leads are routed through corresponding lead zone areas and turn through a right angle to pass across the first lead zone area transverse to the longitudinal axis of the frame and there is a connection pad for connecting each lead to a wire of the cable. The element lead assembly is folded along the folding line so that the second lead zone area is superimposed over the first lead zone area so that the width of the element lead assembly along the frame is equal to or less than the width of the connection side of the frame. The element lead assembly includes a third lead zone wherein the leads are connected to the corresponding connection pads on a second side of the frame and a connector for connecting the wires of the cable to the leads and may include a second element lead assembly and connection assembly located on an opposite side of the frame.

5 Claims, 3 Drawing Sheets

COMPACT ELECTRICAL CONNECTIONS FOR ULTRASONIC TRANSDUCERS

FIELD OF THE INVENTION

The present invention relates to a design and the method of constructing ultrasonic transducers and, in particular, a design and method for connecting to the elements of an ultrasonic transducer.

BACKGROUND OF THE INVENTION

Ultrasonic transducers are used in many medical applications and, in particular, for the non-invasive acquisition of images of organs and conditions within a patient, typical examples being the ultrasound imaging of fetuses and the heart. The ultrasonic transducers used in such applications are generally hand held, and must meet stringent dimensional constraints in order to acquire the desired images. For example, it is frequently necessary that the transducer be able to obtain high resolution images of significant portions of a patient's chest cavity through the gap between two ribs when used for cardiac diagnostic purposes, thereby severely limiting the physical dimensions of the transducer. As a consequence, and because of the relatively small aperture between human ribs and similar constraints upon transducer positioning when attempting to gain images of other parts of the human body, there has been significant development of linear or phased array transducers comprising multiple transmitting and receiving elements, with the associated electronics and switching circuits, to provide relatively narrowly focused and "steerable" transmitting and receiving "beams".

Many such transducers are comprised of a one element wide by multiple element long linear array of transmitting and receiving elements arranged in line along a flat plane or, preferably, along a concave or convex arc, thereby providing a greater scanning arc. The transmitting and receiving beams of such transducers are formed and steered by selecting individual transducers elements or groups of transducer elements to transmit or receive ultrasonic energy, wherein each such individual transducer element or group of transducers elements forms an "aperture" of the transducer array. Such an array is thereby formed of a single row of apertures extending along the face of the array and such transducers are consequently referred to as "single aperture" transducers.

There also transducers that are capable of scanning or focusing in elevation as well as azimuth, that is, along the axis at right angles to the azimuth plane along which the elements are arrayed as well as along the azimuth plane. As is well understood, the formation, steering and focusing of the transmitting and receiving beams of a transducer are controlled by selection and use of the various separate physical divisions or areas of transducer material comprising the transducer array, which, as described above, are referred to as "apertures". In contrast to "single aperture" transducers, however, in which each aperture is formed by an element or group of elements extending across the face of the array as a single unitary area or division or the array, each corresponding element in a transducer capable of scanning in elevation is divided into multiple sub-elements, or segments. For this reason, and because each element position along such an array can form multiple apertures, that is, using different combinations of the sub-elements or segments of each of the transducer elements, such transducers are consequently referred to as "multiple aperture" transducers. The shape, focus and direction of the transmitting and receiving beams of a multiple aperture transducer are again controlled by selection of the apertures of the array. In a multiple aperture array, however, each aperture is formed by one or more of the sub-elements, or segments, of the transducer elements, so that the apertures of a multiple aperture array can be used to steer and focus the transducer scan beam along the elevation axis as well as along the azimuth axis and can define multiple azimuthal scan planes, each being at a different angle of elevation.

Single and multiple aperture transducers are generally constructed from a single piece of transducer material having a width equal to the length of one element and a length equal to the widths of the total number of elements, plus spaces between the elements. One or more element interconnection circuits providing conductive connections and paths interconnecting the individual elements or segments and forming the apertures of the transducer are bonded to one side of the piece of transducer material and a layer or layers of matching material may be bonded to the radiating and receiving side of the transducer material. The assembly comprised of the transducer material, element interconnection circuits and matching layers, if any, is referred to as a "stack" and a temporary or permanent layer of backing material of some form, such as a flexible material, may be bonded to the back of the stack, for example, to aid in handling the stack during manufacture or to comprise a part of the structure of the finished transducer assembly. In addition, one or more layers of impedance matching material is often superimposed upon the transducer elements to match the acoustic impedance of the transducer to the body or material being scanned, and a lens comprised of a suitable material may be additionally superimposed upon the impedance matching material to shape or focus the beams generated by the transducer elements. In some implementations, the impedance matching layers may have suitable acoustic characteristics and may be shaped to operate as an acoustic lens.

A transducer is used in conjunction with a set of transducer electronics that typically include transmitting electronics for driving the aperture elements and segments to generate the ultrasonic signals transmitted by the transducer, receiving electronics for receiving the signals representing the returned ultrasonic signals, and switching elements for selectively connecting the transmitting and receiving electronics to the elements and segments of the apertures to select the aperture or apertures for each transmitted or received signal. It is therefore necessary to provide electrical connections between the apertures, that is, the element interconnection circuits interconnecting the elements and segments of the transducer array to form the apertures, and the transducer electronics and these connections are typically provided through flexible printed circuits and wires running along the body of the transducer.

Providing the electrical connections between the transducer electronics and the elements, sub-elements and segments of the arrays remains a primary problem in constructing transducers, however, particularly as the number of apertures increases. That is, the physical dimensions of an array, especially for medical use, is generally constrained, for example, by the need to scan the cardiac structures through the space between patient's ribs to avoid interference by the ribs. A typical transducer, however, will contain 96 to 128 or more elements or segments which may be used individually or in combinations as apertures, each of which must be individually connected to the transducer electronics.

In a typical transducer, the element interconnection circuits may be comprised, for example, of flexible printed circuits while the connections to the elements and segments are typically brought out for connection to the transducer electronics through a flexible printed circuit. The flexible printed circuit has a lead for each aperture of the transducer and each flexible printed circuit lead is, in turn, connected to a wire of a cable connected to the transducer electronics. In other designs, the wires of the cable connected to the transducer electronics may be connected directly to the element interconnection circuits.

The flexible printed circuit leads and cable wires connecting the apertures connected to the transducer electronics are typically laid out in a transverse orientation relative to the element array, that is, in a straight line from the transducer, so that each flexible printed circuit lead and corresponding cable wire lie in a straight line, thereby requiring a space per wire of at least the diameter of the wire. The flexible printed circuit, the connections between the flexible printed circuit and the cable, and the transducer end of the cable are typically contained within the transducer case, that is, in the "handle" section of the transducer behind the transducer head, and, in a typical 96 to 128 element transducer, thereby require substantial width in the transducer case. This, in turn, results in a relatively bulky and hard to handle transducer.

While it is possible to reduce the size of the transducer "handle", this has typically been accomplished only at the cost of reducing the width of the flexible printed circuit leads and the thickness of the cable wires. This approach, however, results in a mechanically more fragile assembly that is harder to manufacture and more prone to breakage in normal use and that may degrade the quality of the signals between the transducer and the transducer electronics.

In addition, the wires of the cable are typically soldered directly to the flexible printed circuit or, in alternate designs, are run up to the stack and soldered or welded directly to the element interconnection circuits. This requires that the cable wires not only be soldered to the flexible printed circuit during manufacture, but also unsoldered from and resoldered to the flexible printed circuit for repairs to the cable or transducer. Because of the relatively high temperatures involved in soldering and desoldering operations, and in welding operations, there is a significant risk to damage to the flexible printed circuit as well as to the relative fine wires of the cable each time the connections are soldered or unsoldered. As a result, the flexible printed circuit and cable wires can be detached and reconnected only a few times before the cable assembly must be rebuilt or replaced, or the flexible printed circuit is degraded to the point it must be replaced. Also, the transducer stack itself may be damaged in those designs wherein the wires are soldered directly to element interconnection circuits of the stack, so that the transducer stack may have to be replaced.

Finally, it will be noted that the above problems become more difficult with each new generation of transducer designs as there is a need and trend to increase the number of elements or sub-elements to achieve ever finer scan resolution to achieve increasingly detailed images of the anatomic structures, and a correspondingly greater number of connections to be provided.

The present invention provides a solution to these and other problems of the prior art.

SUMMARY OF THE INVENTION

The present invention is directed to an element connection assembly for connecting elements of the transducer stack of an ultrasonic transducer to wires of a cable connecting to transducer electronics wherein the transducer stack is mounted on a generally elongated frame for manipulation of the transducer stack and has a plurality of elements for transmitting and receiving ultrasonic signals.

According to the present invention, the element connection assembly includes a element lead assembly and a connection assembly wherein the element lead assembly has a plurality of leads for and corresponding to certain of the element connections, a first end of each lead being connected to an element, and wherein the element lead assembly is located along a first side of the frame between the transducer stack and an end of the frame and includes a first lead zone area and a second lead area zone, the lead zone areas being spaced apart transverse to the longitudinal axis of the frame and separated from one another by a folding line. The leads are organized into groups corresponding to the lead zone areas wherein with each group of leads being routed through a corresponding lead zone area and turning through a right angle to pass across the first lead zone area in a direction transverse to the longitudinal axis of the frame. The connection assembly has a connection pad for and corresponding to each lead for connection to a corresponding wire of the cable connected to the transducer electronics, wherein each lead is connected to a corresponding connection pad. The element lead assembly is folded along the folding line so that the second lead zone area is superimposed over the first lead zone area so that the width of the element lead assembly along the frame is equal to or less than the width of the connection side of the frame.

In a presently preferred embodiment, the element lead assembly further includes a third lead zone area extending transversely from the first lead zone area wherein the leads extend into the third lead zone area wherein the leads are connected to the corresponding connection pads and the third lead zone area is bent through a right angle relative to the first side of the frame so that the connection assembly and the connections of the leads to the connection pads on the connection assembly are located on a second side of the frame.

In further embodiments, the connection assembly further includes at least one connector having pins corresponding to and connected to corresponding ones of the connection pads and the flexible circuit is terminated into the connector for connecting the wires of the cable to the leads through the connection assembly, the wires being terminated on the back side of the board.

In the presently preferred embodiment, the element lead assembly further includes a second element lead assembly and connection assembly located respectively on an opposite side of the frame from the first element lead assembly and connection assembly and connecting others of the element connections to corresponding wires of the cable connected to the transducer electronics. In this embodiment, the wires of the cable connected to the transducer electronics are organized into groups corresponding to the element connections of the first and second element lead assemblies and connection assemblies for connection respectively to the leads of the first and second element lead assemblies.

Lastly, in the presently preferred embodiment, the element lead assembly is comprised of a flexible circuit and the connection assembly is comprised of a rigid circuit board.

Other features, objects and advantages of the present invention will be understood by those of ordinary skill in the art after reading the following descriptions of a present implementation of the present invention, and after examining the drawings, wherein:

DESCRIPTION OF A PRESENTLY PREFERRED EMBODIMENT

Figure 1:
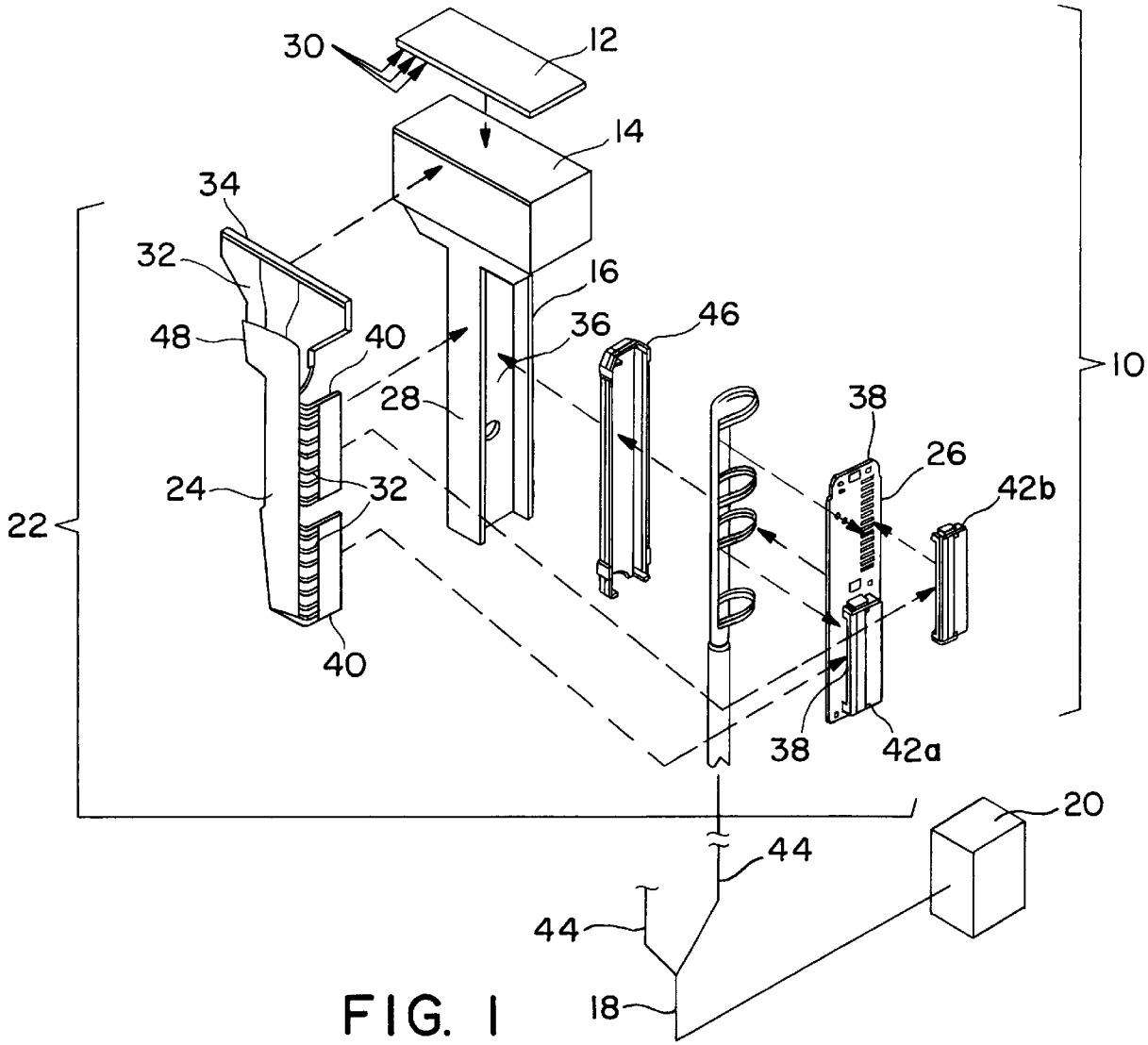
FIG. 1 is an exploded partial isometric view of a transducer according to the present invention.

Referring to FIG. 1, therein is shown an exploded partial isometric view of a Transducer 10 constructed according to the present invention. As shown therein, Transducer 10 includes an Acoustic Stack 12 that, as described herein above, is comprised of a transducer array of radiating and receiving elements or segments formed, for example, of piezoelectric material. As also described, Acoustic Stack 12 may also include a layer or layers of matching material and a temporary or permanent layer of backing material of some form, such as a flexible material, bonded to the back of Acoustic Stack 12.

Acoustic Stack 12 is mounted on a Backing 14, which in turn is mounted on a Frame 16 which, as described further below, provides a core for a handle by which the user can manipulate the transducer and a support for a wiring assembly according to the present invention for connecting the element interconnection circuits of Acoustic Stack 12 to a Cable 18 connected to the Transducer Electronics 20. As has been described herein above, Transducer Electronics 20 typically include transmitting electronics for driving the aperture elements and segments to generate the ultrasonic signals transmitted by the transducer, receiving electronics for receiving the signals representing the returned ultrasonic signals, and switching elements for selectively connecting the transmitting and receiving electronics to the elements and segments of the apertures to select the aperture or apertures for each transmitted or received signal.

According to the present invention, the element interconnection circuits of Acoustic Stack 12 are connected to the wires of Cable 18 to Transducer Electronics 20 through a Element Connection Assembly 22 that includes a Element Lead Assembly 24 comprised, for example, of a flexible printed circuit, and a Connection Assembly 26 comprised, for example, of a rigid printed circuit board. As shown, Element Lead Assembly 24 extends from Acoustic Stack 12, and in particular from a point directly adjoining the element interconnection circuits of Acoustic Stack 12, and along Frame 16 to meet with Connection Assembly 26 which in turn is generally located adjacent the "back" end of Frame 16, that is, the end of Frame 16 away from Acoustic Stack 12 and convenient for connection to Cable 18. It will be noted, as indicated generally in FIG. 1 and as described in detail below, that Element Lead Assembly 24 is represented as being folded over on itself along an axis substantially parallel to the longitudinal axis of Frame 16, thereby significantly reducing the width of Element Lead Assembly 24 along Frame 16.

Figure 5:
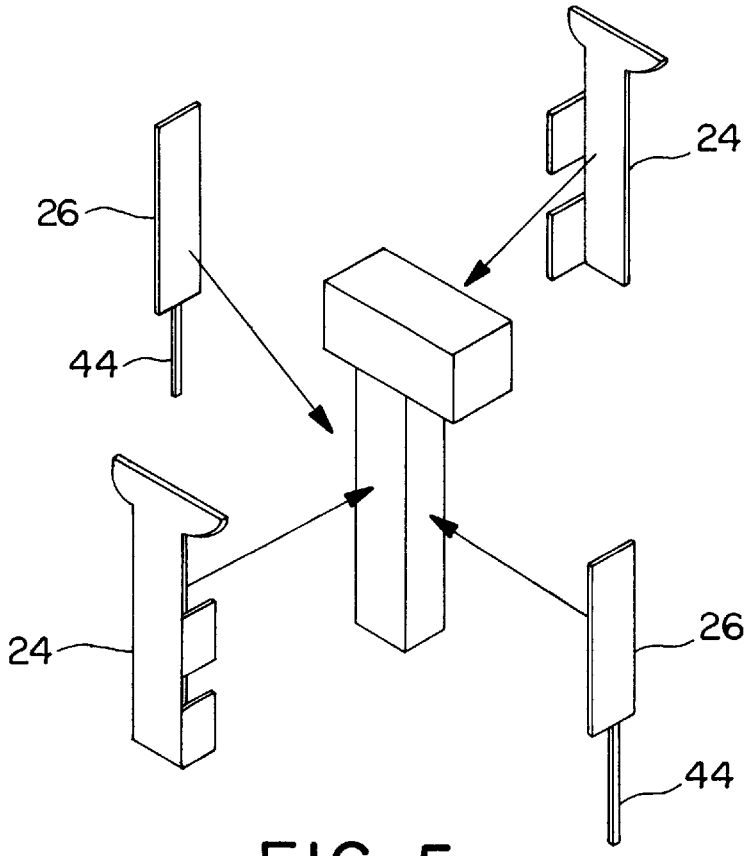

In this regard, it must be noted that for purposes of clarity FIG. 1 illustrates a single "side" of Transducer 10 and shows Element Connection Assembly 22 as comprised of a single Element Lead Assembly 24 and a single Connection Assembly 26 and that the exemplary embodiment shown herein will be described with reference to the single Element Lead Assembly 24 and single Connection Assembly 26 illustrated in FIG. 1. In the presently preferred embodiment, however, and generally in embodiments wherein the transducer array of Acoustic Stack 12 includes relatively large numbers of elements or segments, for example, 96 to 128 or more elements or segments, Element Connection Assembly 22 will be comprised of two Element Lead Assemblies 24 and two Connection Assemblies 26, wherein there will be a Element Lead Assembly 24 and a Connection Assembly 26 on each "side" of Acoustic Stack 12 and Frame 16. This implementation is illustrated in FIG. 5, which illustrates the mounting of two Element Connection Assemblies 22, each comprising an Element Lead Assembly 24 and a Connection Assembly 26, to opposing sides of Frame 16. It will be recognized by those of ordinary skill in the relevant arts, however, that in certain embodiments of the present invention Element Connection Assembly 22 may be comprised of a single Element Lead Assembly 24 and a single Connection Assembly 26.

As generally shown in FIG. 1 and as will be described in further detail below, Element Lead Assembly 24 is located on a Connection Side 28 of Frame 16, wherein Connection Side 28 of Frame 16 is located along and abuts the longitudinal side of the element array of Acoustic Stack 12, that is, the edge of the element array wherein Element Connections 30 to the element interconnection circuits are brought out of the element array and are accessible for connection to Transducer Electronics 20. Element Lead Assembly 24 includes a plurality of Leads 32, one for each connection to be made to a corresponding lead or conductive path of the element interconnection circuits of Acoustic Stack 12, which terminate at the end adjoining Acoustic Stack 12 in a corresponding plurality of Stack Connection Tabs 34 for connection to the corresponding leads of conductive paths of the element interconnection circuits. Element Lead Assembly 24 and Leads 32 then pass longitudinally along Connection Side 28 of Frame 16 toward the "back" end of Frame 16 to a location adjacent Connection Assembly 26, where Leads 32 turn by a first angle, such as 90°, in a direction transverse to the general longitudinal axis of Frame 16. Then, Element Lead Assembly 24 is bent or formed to turn by a second angle, again shown as 90°, to run along Edge Side 36 of Frame 16, again in the direction transverse to the general longitudinal axis of Frame 16. As indicated in FIG. 1, Edge Side 36 of Frame 16 is located along and abuts the end of the element array of Acoustic Stack 12.

Connection Assembly 26 locates on Edge Side 36 of Frame 16 within the channel of Frame 16 and in the region adjacent the "back" end of Frame 16 and, as indicated generally in FIG. 1, is provided with Connector(s) 42, which have pinouts corresponding to each lead of the circuit, a plurality of Connection Pads 38, one for each Lead 32, and each Lead 32 is terminated in a Cable Connection Tab 40 which is inserted into a corresponding Connector 42. As described above, Connection Assembly 26 is preferably comprised of a rigid printed circuit board to provide a rigid termination point for Element Lead Assembly 24 and Cable 18 and, as such, in a generally preferred embodiment Connection Pads 38 are comprised of matching Connection Pads 38 located on opposite sides of Connection Assembly 26 and connected by means of vias through the circuit board, with Leads 32 connecting to the Connection Pads 38 on one side of the circuit board and the corresponding wires of Cable 18 connecting to the corresponding Connection Pads 38 on the other side of the circuit board. In an alternate embodiment, the circuit board may be single sided, with Connection Pads 38 located on only one side of the circuit board and with both Leads 32 and the wires of Cable 18 connecting to Connection Pads 38 on the same side of Connection Assembly 26.

In an exemplary transducer, Transducer Stack 12 may be 22 mm long along Connection Side 28 and 12 mm long along Edge Side 36 and Frame 16 may be made from any material, such as aluminum, and may be 50 mm long from Transducer Stack 12 to its end and may be 5 mm across Connection Side 28 and 10 mm across Edge Side 36. Element Connections 30, in turn, may have 48, 64, 96 to 128 or any desired number of connections, with Element Connection 30 being spaced any desired width apart, such as 100 $\mu$m to 400 $\mu$m or any desired requirement, and with a contact area, for example, 50 $\mu$m by 300 $\mu$m or any other desired dimensions. It will be understood, however, that such a transducer can be constructed with any of a wide range of lengths and widths, depending on the pitch and number of the elements of the transducer.

In yet other embodiments, Connection Assembly 26 includes one or more Connectors 42*a*, one of which is shown in FIG. 1, which are mounted to the rigid printed circuit board of Connection Assembly 26 and connected to Connection Pads 38 and the Leads 32 of Element Lead Assembly 24 are terminated in and connected to one or more corresponding mating Connectors 42, two of which are shown in FIG. 1, with through vias to Connector Pads 38, which have wires of Cable 18 terminated on them to establish the connection between Cable 18 and the leads of Element Lead Assembly 24. In a typical embodiment, Connectors 42 may contain, for example, up to 50 to 200 connector pins.

Finally, and as described above, in the presently preferred embodiment Element Connection Assembly 22 will be comprised of two Element Lead Assemblies 24 and two Connection Assemblies 26, wherein there will be a Element Lead Assembly 24 and a Connection Assembly 26 on each "side" of Acoustic Stack 12 and Frame 16. That is, there will be a Element Lead Assembly 24 located on the Connection Side 28 of Frame 16 opposite that shown in FIG. 1, located along and abutting the opposite longitudinal side of the element array of Acoustic Stack 12. The second Element Lead Assembly 24 again includes a plurality of Leads 32, one for each connection to be made to a corresponding lead or conductive path of the element interconnection circuits of Acoustic Stack 12, which again terminate at the end adjoining Acoustic Stack 12 in a corresponding plurality of Stack Connection Tabs 34 for connection to corresponding leads of conductive paths of the element interconnection circuits accessible on the opposite side of the transducer array. The second Element Lead Assembly 24 and its Leads 32 then pass longitudinally along opposite Connection Side 28 of Frame 16 toward the "back" end of Frame 16 to a location adjacent the second Connection Assembly 26, where Leads 32 turn by a first angle in a direction transverse to the general longitudinal axis of Frame 16, such as 90°, and then Connection Assembly 24 is bent or formed to turn by a second angle, again such as 90°, to run along the Edge Side 36 of Frame 16 opposite the Edge Side 36 shown in FIG. 1, again in the direction transverse to the general longitudinal axis of Frame 16.

The second Connection Assembly 26 is likewise located in the channel of Frame 16 on the opposite Edge Side 36 of Frame 16, again in the region adjacent the "back" end of Frame 16, and is likewise provided with a plurality of Connection Pads 38, one for each wire of Cable 18, and is then connected through vias through the board to the connector wherein, wherein each Lead 32 is again terminated in a Cable Connection Tab 40 which is connected to a corresponding Connector 42. Again, in the generally preferred embodiment the Connection Pads 38 are comprised of matching Connection Pads 38 located on opposite sides of Connection Assembly 26 with Leads 32 of Tab 40 connecting to the Connector 42 on one side of the circuit board and the corresponding wires of Cable 18 connecting to the corresponding Connection Pads 38 on the other side of the circuit board. In the alternate embodiments, again, the circuit board may be single sided, with both Leads 32 and the wires of Cable 18 connecting to Connection Pads 38 on the same side of Connection Assembly 26, or may be provided with Connectors 42*a* and 42*b* for connecting Leads 32 to the wires of Cable 18.

In this regard, it is shown in FIG. 1 that, in the embodiment having a Connection Assembly 26 on either side of Frame 16, Cable 18 is divided into two Wire Groups 44 of wires near the end of Cable 18 close to Frame 16 and the wires of each Wire Group 44 are connected to a respective one of Connection Assemblies 26. It is also shown that the wires of each Wire Group 44 are essentially colinear with the axis of Frame 16 as they approach Frame 16 and that the wires of each Wire Group 44 are then dressed, or turned, through 90° to be attached to the Connector Pads 38 of Connector Assembly 26. The longitudinal axis of Connector 42*b*, like that of mating Connector 42*a*, thereby lies parallel to the longitudinal axis of Frame 16 so that the connection between Connection Assembly 26 and Cable 18 is relatively narrow and thereby allows easier handling of Transducer 10 by a user.

In yet other embodiments, requiring fewer connections between the elements of Transducer Stack 12 and Transducer Electronics 20, only a single Connection Assembly 26 is necessary for the required number of connections and Cable 18 is not divided into two Wire Groups 44; otherwise, the connection between Cable 18 and Connection Assembly 26 is the same as just described, with the wires of Cable 18 being dressed through 90° before connection to a Connector 42*b* or Connection Pads 38.

Also, in certain embodiments Element Lead Assembly 24 may not be turned through the second 90° angle and parallel to the longitudinal axis of Frame 16 to bring Cable Connection Tabs 40 onto Edge Side 36 of Frame 16, so that Cable Connection Tabs 40 and Connectors 42, if used, are located on the Connection Sides 28 of Frame 16, possibly adjacent Edge Sides 36.

In still further embodiments, a Transducer Stack 12 may have Element Connections 30 on one or more ends of the Transducer Stack 12, as well as on the sides, and there may be Element Lead Assemblies 24 located on one or more Edge Sides 36 of Frame 16 as well as on Connection Sides 28. In these cases, the additional Connection Assemblies 26 for the Edge Side 36 Element Lead Assemblies 24 may be located on their Edge Sides 36, in the manner just described, or the Element Lead Assemblies 24 may turn through 90° so that their Connection Assemblies 26 are located on the respective Connection Sides 28.

Lastly, it is shown in FIG. 1 that Transducer 10 includes a Wire Cap 46 to cover and protect each Connection Assembly 26 and the connections of Element Lead Assembly 24 and Cable 18 to Connection Assembly 26.

Figure 2:
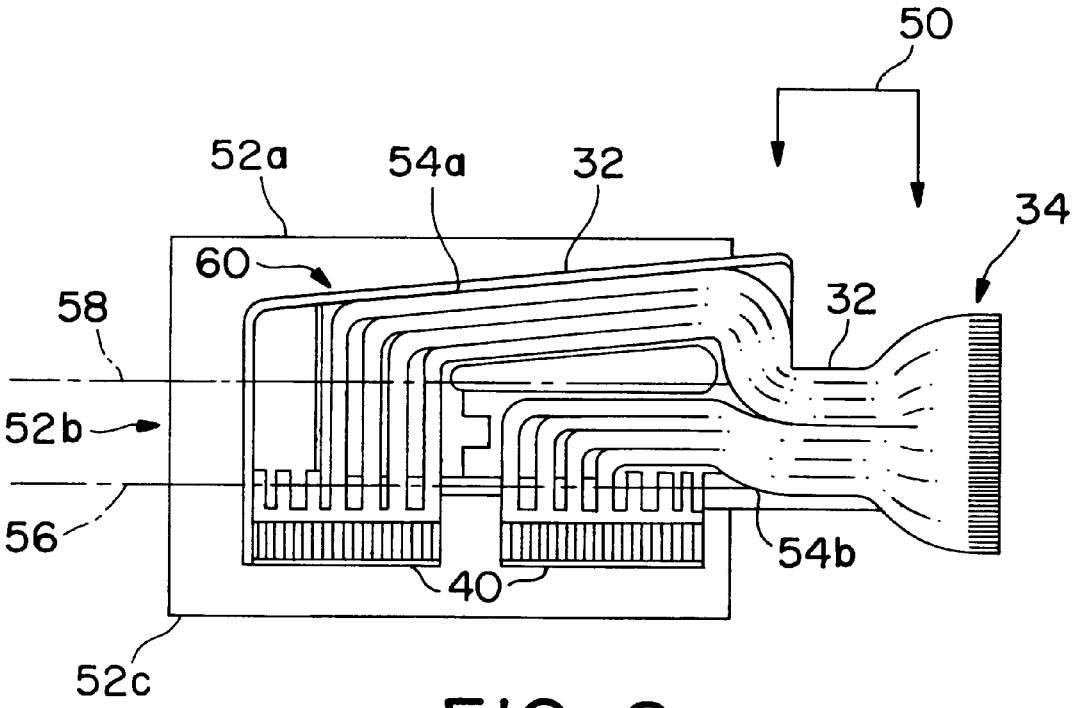
FIG. 2 is a diagrammic view of a flexible circuit according to the present invention.

Referring now to FIG. 2, therein is shown a diagrammic representation of Element Lead Assembly 24. As shown therein, Element Lead Assembly 24 is unfolded during its creation, but is folded before attachment to Element Connections 30. Element Lead Assembly 24 includes a plurality of Leads 32, one for each connection to be made to a corresponding lead or conductive path of the element interconnection circuits of Acoustic Stack 12, which terminate at Transducer End 48 of Element Lead Assembly 24 adjoining Acoustic Stack 12 in a corresponding plurality of Stack Connection Tabs 34 for connection to Element Connections 30 of the corresponding leads or conductive paths of the element interconnection circuits of Transducer Stack 12. It will be noted that Transducer End 48 of Element Lead Assembly 24 is equal to the width of Element Connections 30 wherein Stack Connection Tabs 32 are connected to Element Connections 30 and narrows to the width of Connection Side 28 of Frame 16, thereby allowing additional width for bonding or attachment of Element Lead Assembly 24 to Backing 14 in the area of Element Connections 30. In a typical embodiment, each of Connection Tabs 34 may be 50 $\mu$m or more wide by 1.2 mm or more long and a center to center spacing as necessary for a particular design, such as, 420 $\mu$m.

It will be noted that Leads 32 are spaced apart from one another in the area adjacent Connection Tabs 34 by the distance necessary to align Connection Tabs 34 with Element Connections 30 and to allow the maximum widths for Connection Tabs 34 and Element Connections 30. Leads 32 then pass longitudinally along Connection Side 28 of Frame 16 toward the "back" end of Frame 16, and in doing so may first pass through a Width Transition Zone 50 wherein the spacing between Leads 32 is reduced from the spacing in the area of Connection Tabs 34 to a spacing sufficient for electrical isolation between Leads 32. A Width Transition Zone 50 may not be necessary, or preferable, however, depending upon the number and required minimum spacing between Leads 32 and the width available across Connection Side 28 of Frame 16 for Element Lead Assembly 24 in its folded configuration. In a typical embodiment, Leads 32 will be may be 102 $\mu$m wide in Width Transition Zone 50, and may be spaced 102 $\mu$m apart while Width Transition Zone 50 may have a length along Frame 16 as necessary for the particular design, such as 12 mm.

The area of Element Lead Assembly 24 between Width Transition Zone 50 and the end of Frame 16 is of increased width and is divided into two Lead Zones 52*a* and 52*b* wherein Leads 32 are divided into two Groups 54*a* and 54*b* that are spaced apart from one another and are routed through Lead Zones 52*a* and 52*b*, respectively. The Leads 32 of each of Groups 54*a* and 54*b* then turn through 90° in the direction transverse to the general longitudinal axis of Frame 16, with the Leads 32 of Group 54*a* pass across the area of Lead Zone 52*b* in parallel with the Leads 32 of Group 54*b* to pass into a Lead Zone 52*c* extending transversely to Lead Zone 52*b* wherein each Lead 32 is terminated in a Cable Connection Pad 40.

Figure 4:
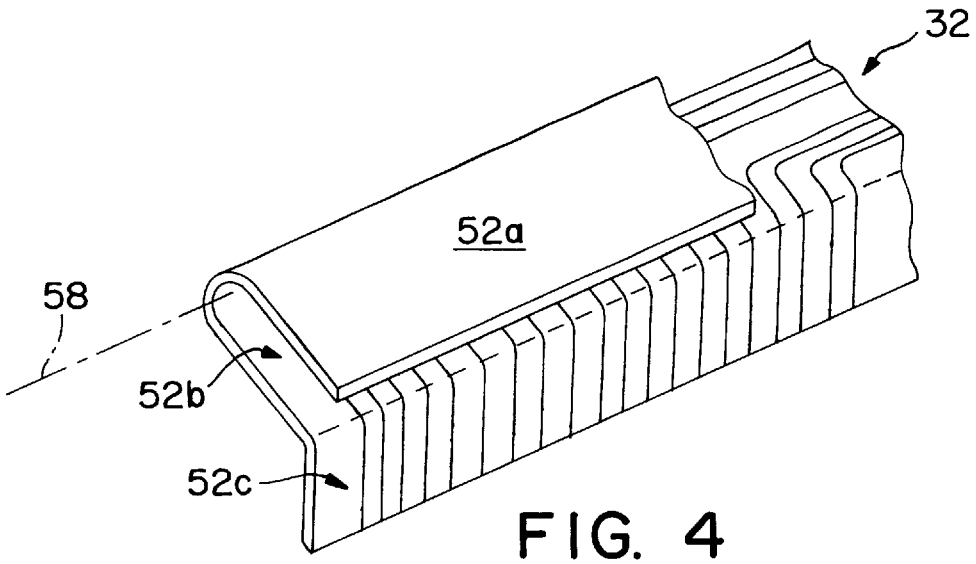
FIG. 4 illustrates the folding of the element lead assembly flexible circuit along the fold line so that the first lead zone area overlays the second lead zone area and the second bending of the flexible circuit along a corner line so that the cable connection tabs are located along an edge side of the transducer frame; and, FIG. 5 illustrates the mounting of two element connection assemblies, each comprising an element lead assembly and a connection assembly, to opposing sides of the transducer frame.

As has been described above, and as illustrated in FIG. 4, Lead Assembly 24 and, in particular the area of Element Lead Assembly 24 comprising Lead Zone 52*c*, is then turned through a second 90° angle along a Corner Line 56 parallel to the longitudinal axis of Frame 16 and in the area between the 90° turn of Leads 32 and Cable Connection Tabs 40 to run along Edge Side 36 of Frame 16 so that Cable Connection Tabs 40 are located on Edge Side 36 of Frame 16.

It has been described above and as illustrated in FIG. 4, that Element Lead Assembly 24 is folded over on itself along an axis parallel to the longitudinal axis of Frame 16, indicated in FIG. 2 as Fold Line 58, thereby significantly reducing the width of Element Lead Assembly 24 along Frame 16. In this regard, and for this purpose, it is shown in FIG. 2 that while Group 54*a* is generally colinear with its Leads 32 in the area of Width Transition Zone 50 and Connection Tabs 34, Group 54*b* is not colinear with its Leads 32 in the area of Width Transition Zone 50 and Connection Tabs 34 and is offset with respect to Group 54*a*. The distance between Lead Zones 52*a* and 52*b* with Groups 54*a* and 54*b*, and the widths of the regions of Element Lead Assembly 24 occupied by Lead Zones 52*a* and 52*b* with Groups 54*a* and 54*b*, are selected such that Element Lead Assembly 24 may be folded along Fold Line 58, which passes along the space between Lead Zones 52*a* and 52*b*, so that Group 54*b* will generally overlay Group 54*b*, so that Outer Edge 60 of Element Lead Assembly 24 does not overlap Cable Connection Tabs 40 or extend past Corner Line 56, and so that the width of the folded Element Lead Assembly 24 between Fold Line 58 and Corner Line 56, or in an alternate embodiment described below, Cable Connection Tabs 40, falls within the width of Connection Side 28 of Frame 16.

It will be noted that in an alternate embodiment of the present invention, as mentioned previously, Element Lead Assembly 24 may not be turned through a second 90° angle along Corner Line 56 parallel to the longitudinal axis of Frame 16 so that Cable Connection Tabs 40 are located on Edge Side 36 of Frame 16. In this embodiment, Cable Connection Tabs 40, and Connectors 42*a* may be located on Connection Side 28 of Frame 16, possibly adjacent Edge Side 36, and, in this embodiment, the distance between Lead Zones 52*a* and 52*b* with Groups 54*a* and 54*b*, and the widths of the regions of Element Lead Assembly 24 occupied by Lead Zones 52*a* and 52*b* with Groups 54*a* and 54*b*, are selected such that Outer Edge 60 of Element Lead Assembly 24 does not overlap Cable Connection Tabs 40.

It will also be understood by those of ordinary skill in the relevant arts that Groups 54 need not all include the same number of Leads 32, and that the Leads 32 in the Groups 54 may be provided for different uses and functions. For example, certain Leads 32 may carry bias voltages or ground connections while others may carry signals, and the Leads 32 may be grouped or distributed accordingly. In addition, and in those embodiments having more than one Element Lead Assembly 24 and Connection Assembly 26, the uses and functions of the Leads 32 of the Element Lead Assemblies 24 and Connection Assemblies 26 may differ. For example, and again, bias voltages or grounds may be carried in only one of the Element Lead Assemblies 24 or the Element Lead Assemblies 24 may have different numbers of Leads 32, as may the two Wire Groups 44.

In yet other embodiments of the present invention, Leads 32 may be divided into three or more Lead Zones 52, each with a Group 54 of Leads 32 wherein each Lead Zones 52 with its Group 54 is spaced apart from the other Lead Zones 52 with their Groups 54 in the manner described above and wherein the Leads 32 of each Group 54 are again turned through 90° before being terminated in a Cable Connection Pad 40 and wherein Element Lead Assembly 24 is again turned through a second 90° angle along Corner Line 56 so that Cable Connection Tabs 40 are located on Edge Side 36 of Frame 16. In this embodiment, there will again be Fold Lines 58 between Lead Zones 52 and the Element Lead Assembly 24 will be accordion folded along the Fold Lines 58 so that the folded Element Lead Assembly 24 assumes the configuration along Connection Side 28 described above. Again, in those implementations having more than one Element Lead Assembly 24, the Element Lead Assemblies 24 need not have the same number of Lead Zones 52 and Groups 54 or Connectors 42.

Figure 3:
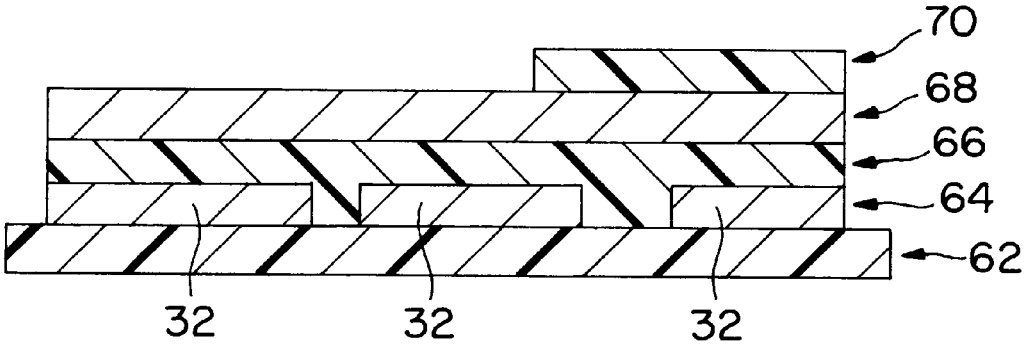
FIG. 3 is a cross section of a flexible circuit according to the present invention.

Finally referring to FIG. 3, it is shown therein that in a presently preferred embodiment of the present invention Element Lead Assembly 24 is comprised of a multilayer flexible circuit having a Base Layer 62, a Trace Layer 64 in which Leads 32 are formed, an Isolation Layer 66 and a Ground Layer 68 wherein, and for example, Base Layer may be comprised of polymide approximately 1 mil thick, Trace Layer 64 may be comprised of copper approximately 1.4 mils thick and Ground Layer 68 may be comprised of copper and approximately 1.4 mils thick. Element Lead Assembly 24, and indicated generally in FIG. 3, may also include Stiffeners 70 in the region of Cable Connection Tabs 40 wherein Stiffeners 70 may be comprised of polymide chosen such that the total thickness in this area is 12 mils (0.3 mm) thick.

It will be understood by those of ordinary skill in the relevant arts from the above descriptions that the element connection assembly of the present invention provides a smaller and more easily manipulated handle by which a user may manipulate and use the transducer and a more robust and better protected assembly and connection between the transducer and the cable connecting to the transducer electronics that will be less prone to breakage or damage in use. In addition, the element connection assembly of the present invention allows the cable to be readily attached and detached and provides easier assembly during manufacture and easier repair with reduced risk of damage to the element lead assembly, the element connection assembly and the cable.

Lastly, while the invention has been particularly shown and described with reference to preferred embodiments of the apparatus and methods thereof, it will be also understood by those of ordinary skill in the art that various changes, variations and modifications in form, details and implementation may be made therein, as has been discussed herein above, without departing from the spirit and scope of the invention as defined by the appended claims.

What is claimed is:

1. An element connection assembly for connecting element connections of a transducer stack of an ultrasonic transducer to wires of a cable connecting to transducer electronics, the transducer stack being mounted on a generally elongated frame for manipulation of the transducer stack and having a plurality of elements for transmitting and receiving ultrasonic signals, comprising:

an element lead assembly having a plurality of leads for and corresponding to certain of the element connections, a first end of each lead being connected to an element connection, the element lead assembly being located along a first side of the frame between the transducer stack and an end of the frame and including a first lead zone area and a second lead zone area, the lead zone areas being spaced apart transverse to the longitudinal axis of the frame and separated from one another by a folding line, the leads being organized into groups corresponding to the lead zone areas, each group of leads being routed through a corresponding lead zone area and turning through a right angle to pass across the first lead zone area in a direction transverse to the longitudinal axis of the frame, and the element lead assembly being folded along the folding line so that the second lead zone area is superimposed over the first lead zone area so that the width of the element lead assembly along the frame is equal to or less than the width of the connection side of the frame, and a connection assembly having a connection pad for and corresponding to each lead for connection to a corresponding wire of the cable connected to the transducer electronics, wherein each lead is connected to a corresponding connection pad.

2. An element connection assembly for connecting element connections of a transducer stack of an ultrasonic transducer to wires of a cable connecting to transducer electronics, the transducer stack being mounted on a generally elongated frame for manipulation of the transducer stack and having a plurality of elements for transmitting and receiving ultrasonic signals, comprising:

an element lead assembly having a plurality of leads for and corresponding to certain of the element connections, a first end of each lead being connected to an element connection, the element lead assembly being located along a first side of the frame between the transducer stack and an end of the frame and including a first lead zone area and a second lead zone area, the lead zone areas being spaced apart transverse to the longitudinal axis of the frame and separated from one another by a folding line, the leads being organized into groups corresponding to the lead zone areas, each group of leads being routed through a corresponding lead zone area and turning through a right angle to pass across the first lead zone area in a direction transverse to the longitudinal axis of the frame, and the element lead assembly being folded along the folding line so that the second lead zone area is superimposed over the first lead zone area so that the width of the element lead assembly along the frame is equal to or less than the width of the connection side of the frame, and a connection assembly having a connection pad for and corresponding to each lead for connection to a corresponding wire of the cable connected to the transducer electronics, wherein each lead is connected to a corresponding connection pad and wherein the element lead assembly further includes a third lead zone area extending transversely from the first lead zone area, the leads extend into the third lead zone area wherein the leads are connected to the corresponding connection pads, and the third lead zone area is bent through a right angle relative to the first side of the frame so that the connection assembly and the connections of the leads to the connectors on the connection assembly are located on a second side of the frame.

3. An element connection assembly for connecting element connections of a transducer stack of an ultrasonic transducer to wires of a cable connecting to transducer electronics, the transducer stack being mounted on a generally elongated frame for manipulation of the transducer stack and having a plurality of elements for transmitting and receiving ultrasonic signals, comprising:

an element lead assembly having a plurality of leads for and corresponding to certain of the element connections, a first end of each lead being connected to an element connection, the element lead assembly being located along a first side of the frame between the transducer stack and an end of the frame and including a first lead zone area and a second lead zone area, the lead zone areas being spaced apart transverse to the longitudinal axis of the frame and separated from one another by a folding line, the leads being organized into groups corresponding to the lead zone areas, each group of leads being routed through a corresponding lead zone area and turning through a right angle to pass across the first lead zone area in a direction transverse to the longitudinal axis of the frame, and the element lead assembly being folded along the folding line so that the second lead zone area is superimposed over the first lead zone area so that the width of the element lead assembly along the frame is equal to or less than the width of the connection side of the frame, and a connection assembly having a connection pad for and corresponding to each lead for connection to a corresponding wire of the cable connected to the transducer electronics, wherein each lead is connected to a corresponding connection pad wherein the connection assembly further includes at least one connector having pins corresponding to and connected to corresponding ones of the connection pads, and the wires of the cable connected to the transducer electronics are terminated onto the connection pads for connecting the wires of the cable to the leads through the connection assembly.

4. An element connection assembly for connecting element connections of a transducer stack of an ultrasonic transducer to wires of a cable connecting to transducer electronics, the transducer stack being mounted on a generally elongated frame for manipulation of the transducer stack and having a plurality of elements for transmitting and receiving ultrasonic signals, comprising:

an element lead assembly having a plurality of leads for and corresponding to certain of the element connections, a first end of each lead being connected to an element connection, the element lead assembly being located along a first side of the frame between the transducer stack and an end of the frame and including a first lead zone area and a second lead zone area, the lead zone areas being spaced apart transverse to the longitudinal axis of the frame and separated from one another by a folding line, the leads being organized into groups corresponding to the lead zone areas, each group of leads being routed through a corresponding lead zone area and turning through a right angle to pass across the first lead zone area in a direction transverse to the longitudinal axis of the frame, and the element lead assembly being folded along the folding line so that the second lead zone area is superimposed over the first lead zone area so that the width of the element lead assembly along the frame is equal to or less than the width of the connection side of the frame, a connection assembly having a connection pad for and corresponding to each lead for connection to a corresponding wire of the cable connected to the transducer electronics, wherein each lead is connected to a corresponding connection pad, and a second element lead assembly and connection assembly located respectively on opposite sides of the frame from the first element lead assembly and connection assembly and connecting others of the element connections to corresponding wires of the cable connected to the transducer electronics, the wires of the cable connected to the transducer electronics being organized into groups corresponding to the element connections of the first and second element lead assemblies and connection assemblies for connection respectively to the leads of the first and second element lead assemblies.

5. An element connection assembly for connecting element connections of a transducer stack of an ultrasonic transducer to wires of a cable connecting to transducer electronics, the transducer stack being mounted on a generally elongated frame for manipulation of the transducer stack and having a plurality of elements for transmitting and receiving ultrasonic signals, comprising:

an element lead assembly having a plurality of leads for and corresponding to certain of the element connections, a first end of each lead being connected to an element connection, the element lead assembly being located along a first side of the frame between the transducer stack and an end of the frame and including a first lead zone area and a second lead zone area, the lead zone areas being spaced apart transverse to the longitudinal axis of the frame and separated from one another by a folding line, the leads being organized into groups corresponding to the lead zone areas, each group of leads being routed through a corresponding lead zone area and turning through a right angle to pass across the first lead zone area in a direction transverse to the longitudinal axis of the frame, and the element lead assembly being folded along the folding line so that the second lead zone area is superimposed over the first lead zone area so that the width of the element lead assembly along the frame is equal to or less than the width of the connection side of the frame, and a connection assembly having a connection pad for and corresponding to each lead for connection to a corresponding wire of the cable connected to the transducer electronics, wherein each lead is connected to a corresponding connection pad wherein the element lead assembly is comprised of a flexible circuit and the connection assembly is comprised of a rigid circuit board.

* * * * *